US005557828A

United States Patent [19]

Reiner et al.

[11] Patent Number: 5,557,828

[45] Date of Patent: Sep. 24, 1996

[54] LOAD CENTER DOOR HINGE ELEMENT

[75] Inventors: Richard A. Reiner, Hanover Township; John E. Swedowski, Parks Township, both of Pa.

[73] Assignee: Eaton Corporation, Cleveland, Ohio

[21] Appl. No.: 500,809

[22] Filed: Jul. 6, 1995

[51] Int. Cl.[6] ..... E05D 7/00

[52] U.S. Cl. ..... 16/257; 16/254; 16/221

[58] Field of Search ..... 16/268, 386, 254, 16/257, 259, 261, 262, 270, 221

[56] References Cited

U.S. PATENT DOCUMENTS

| | | | |
|---|---|---|---|
| 2,675,925 | 4/1954 | Skar | 16/268 |
| 4,617,699 | 10/1986 | Nakamura | 16/262 |
| 5,259,091 | 11/1993 | Mordick | 16/254 |

*Primary Examiner*—M. Rachuba
*Assistant Examiner*—Donald M. Gurley
*Attorney, Agent, or Firm*—Martin J. Moran

[57] ABSTRACT

A U-shaped hinge element used to pivotally mount a door to a cover dead front of an enclosure for circuit breaker handles of a load center. The hinge element has spaced-apart wall members, and is characterized by having a projection formed out of the surface of a first wall member which positively engages a back surface of the cover dead front to partially retain the one wall member when the hinge element is initially inserted into the cover dead front and by having laterally opposed, bendable tab means formed out of the surface of a second wall member which are manually bent after the hinge element is inserted into the dead front cover. Converging slots are formed in the second wall member to form the bendable tab means, and the hinge element is made of stainless steel.

5 Claims, 4 Drawing Sheets

FIG. 3
PRIOR ART
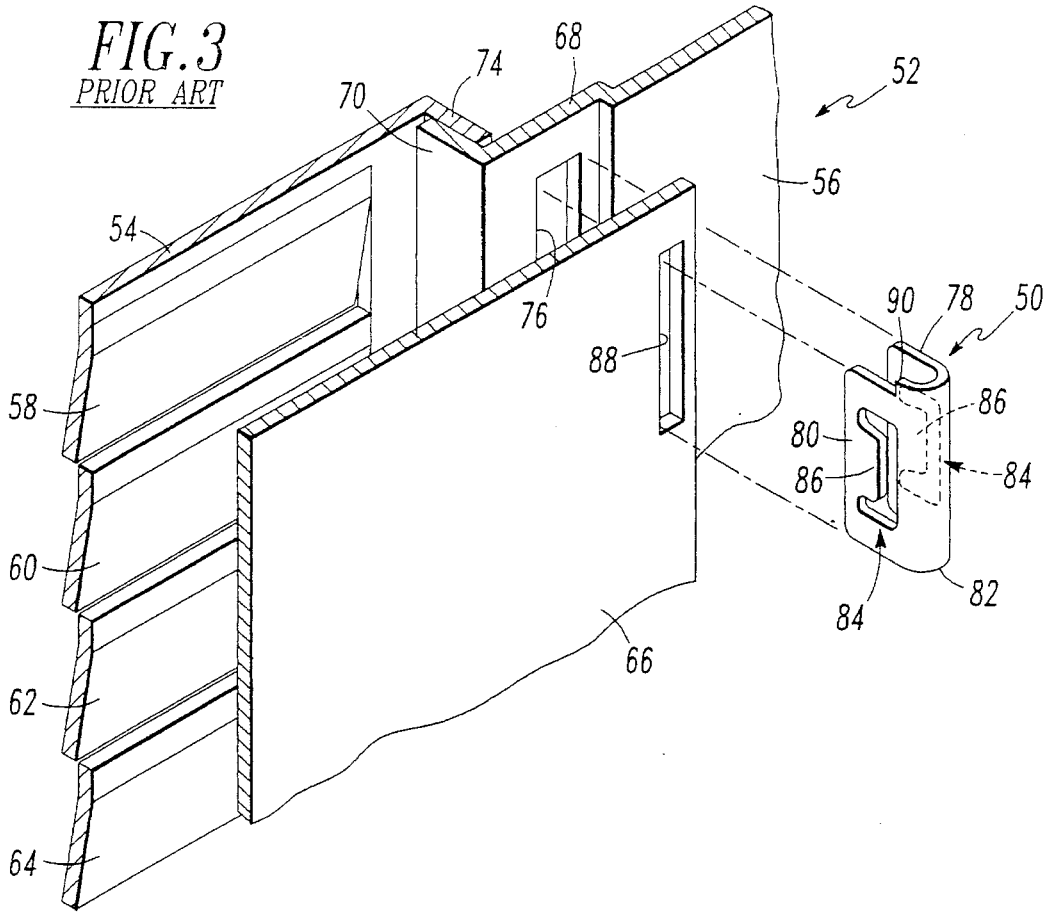
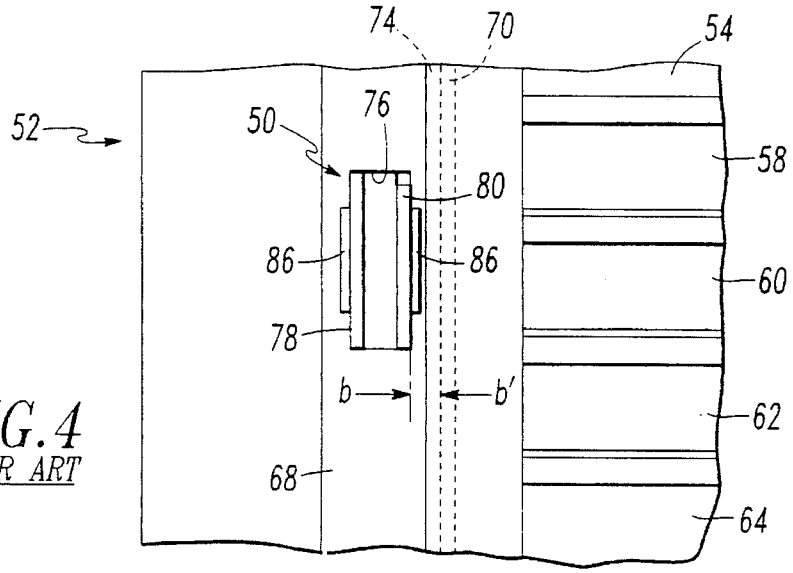
FIG. 4
PRIOR ART

LOAD CENTER DOOR HINGE ELEMENT

BACKGROUND OF THE INVENTION

1. Field of the Invention

The invention relates to an improved hinge element for pivotally mounting a door to a cover dead front of an enclosure which generally covers and protects circuit breaker handles in a load center for a residential dwelling or commercial building.

2. Description of the Prior Art

Circuit breaker load centers in commercial and residential constructions are well-known. The load center generally is covered and protected by an enclosure comprising an inner cover with several twist-out sections for receiving the handles of the circuit breakers, a cover dead front which generally fits into and over the wall opening where the handles are located, and a door pivotally mounted to the cover dead front which provides access to the handles of the circuit breakers extending through the removed twist-out sections of the inner cover. The inner cover may be integrally formed with the cover dead front or it may be a separate piece connected by screws to the cover dead front and adjustable relative thereto. The front surface of the cover dead front forms a recess portion which receives the door and which terminates to form a peripheral ledge which, in turn, forms a central opening in the cover dead front for access to the handles of the circuit breakers extending in the twist-out sections which have been removed for this purpose. An aperture is provided along an edge of the recess portion of the cover dead front for receiving a hinge element which pivotally mounts the door to the cover dead front. If the inner cover and the cover dead front are integrally formed, usually a wide gap exists between the aperture in the cover dead front which receives the hinge element and the peripheral ledge of the central opening in the cover dead front on the back surface of the cover dead front. If the inner cover and the cover dead front are separate pieces and the inner cover is adjustable relative to the cover dead front, the end walls of the cover dead front may be caused to move into this gap between the aperture in the cover dead front for receiving the hinge element and the peripheral ledge of the central opening in the cover dead front resulting in a limited amount of space in this gap.

Generally, the door of the closure has an aperture which is located along a longitudinal edge of the door and which corresponds in number to the apertures in the cover dead front.

The hinge element is U-shaped with spaced-apart wall members bridged by a curved portion and retaining means on each wall member for fixing the hinge element in position. In the mounting of the door onto the cover dead front, the hinge element is installed with one of the wall members being received in the door aperture and in the aperture in the cover dead front, and the other wall member being received in the aperture in the cover dead front with the longitudinal edge of the door adjacent to the door aperture being received in the curved portion of the hinge element.

One form of the retaining means on the hinge element, which is presently used by the former owner of the assignee of this invention, involves a bendable tab on each spaced-apart wall member which is manually bent in an outward direction once the hinge element is installed. These tabs are located diagonally relative to each other and are formed by forming a slanted slot into a lateral edge of each wall member. This hinge element is generally made of a hard material such as stainless steel, which requires the robs to be manually bent by a tool such as pliers. This hinge element is generally used when the enclosure for the circuit breaker handles comprises an integrally formed inner cover and cover dead front in that there is enough space existing in the gap between the aperture in the cover dead front and the peripheral ledge forming the central opening in the cover dead front so that the tab closest to the central opening in the cover dead front can be manually bent toward this central opening without encountering interference from the peripheral ledge of the central opening.

Another form of the retaining means tier a U-shaped hinge element for an enclosure in a load center involves a central projection which is punched out of each wall member and which points toward the curved portion of the hinge element. This type of hinge element is generally made of brass which provides a degree of resiliency such that when the hinge element is installed, the central projections are pushed inwardly by the aperture walls and spring outwardly once the wall members of the hinge element pass through the aperture. This provides an automatic and positive engagement of the hinge element without any manual intervention by a workman. This kind of hinge element is generally used when the enclosure comprises an inner cover which is separate from and adjustable relative to the cover dead front where the end walls of the inner cover take up most of the space in the gap between the aperture in the cover dead front and the peripheral ledge of the central opening of the cover dead front as the extension of the central projections on the wall members of the hinge element is minimal requiring a minimal amount of space for retaining the hinge element in the cover dead front.

This latter type of hinge element may be advantageous in that it can easily be installed as it automatically snaps into place without manual intervention. However, it has some drawbacks in that the central projections can easily shear off due to their construction and the type of material used in this hinge element. Additionally, the central projections provide a minimal latching surface for the hinge device thereby creating a precarious situation where the hinge element can be dislodged from its holding position.

There remains, therefore, a very real and substantial need for a stronger U-shaped hinge element which provides an increased holding force and a more sturdy construction for the retaining means on each wall member so that the retaining means cannot be easily sheared off.

SUMMARY OF THE INVENTION

The present invention has met the above-described need. The present invention involves a hinge element for pivotally mounting a door to a cover dead front of an enclosure for covering and protecting circuit breaker handles in a load center. The hinge element has spaced-apart wall members; a first wall member having a projection formed out of its surface and a second wall member having laterally opposed bendable tab means which are formed in the surface of the second wall member by converging slots. The projection of the first wall member provides a positive, partial retention of the hinge member in the cover dead front, and bending of the tab means completes the retention of the hinge member and therefore the door in the cover dead front. The extension of the projection when in its operable mode, preferably, is less than the extension of the bendable tab means when in their operable, bender mode. Preferably, the first wall member with the projection is located in close proximity to a central opening in the cover dead front for accessing the handles of the circuit breakers, and the second wall member with the opposed tab means is located remotely from the central opening of the cover dead front. This hinge element finds particular application in an enclosure employing a two-piece construction for the cover dead front and the inner cover as discussed hereinabove. This hinge element of the present invention provides a sufficient holding force and retention of both wall members in the aperture of the cover dead front, while still providing enough space in the gap between the aperture in the cover dead front and the peripheral ledge of the central opening in the cover dead front so that the longitudinal end walls of the inner cover can move in this gap during adjustment of the inner cover relative to the cover dead front. Preferably, the hinge element is made of stainless steel which requires the tab means to be bent by a tool, such as pliers.

It is, therefore, an object of the present invention to provide an improved hinge element for a unit for enclosing a load center which is made of a durable material, which provides a positive catch on at least one wall member of the hinge element, and which comprises a sturdy construction for the retaining means on the wall members.

These and other objects of the present invention will be more fully understood and appreciated from the following description of the invention on reference to the illustrations appended hereto:

BRIEF DESCRIPTION OF THE DRAWINGS

FIG. 3 is an exploded, partial perspective view of an enclosure for a load center illustrating a second example of a hinge element of the prior art;

FIG. 4 is a rear view showing the hinge element of FIG. 3 and the manner in which it is affixed within the enclosure of the load center;

DESCRIPTION OF THE PREFERRED EMBODIMENT

Figure 1:
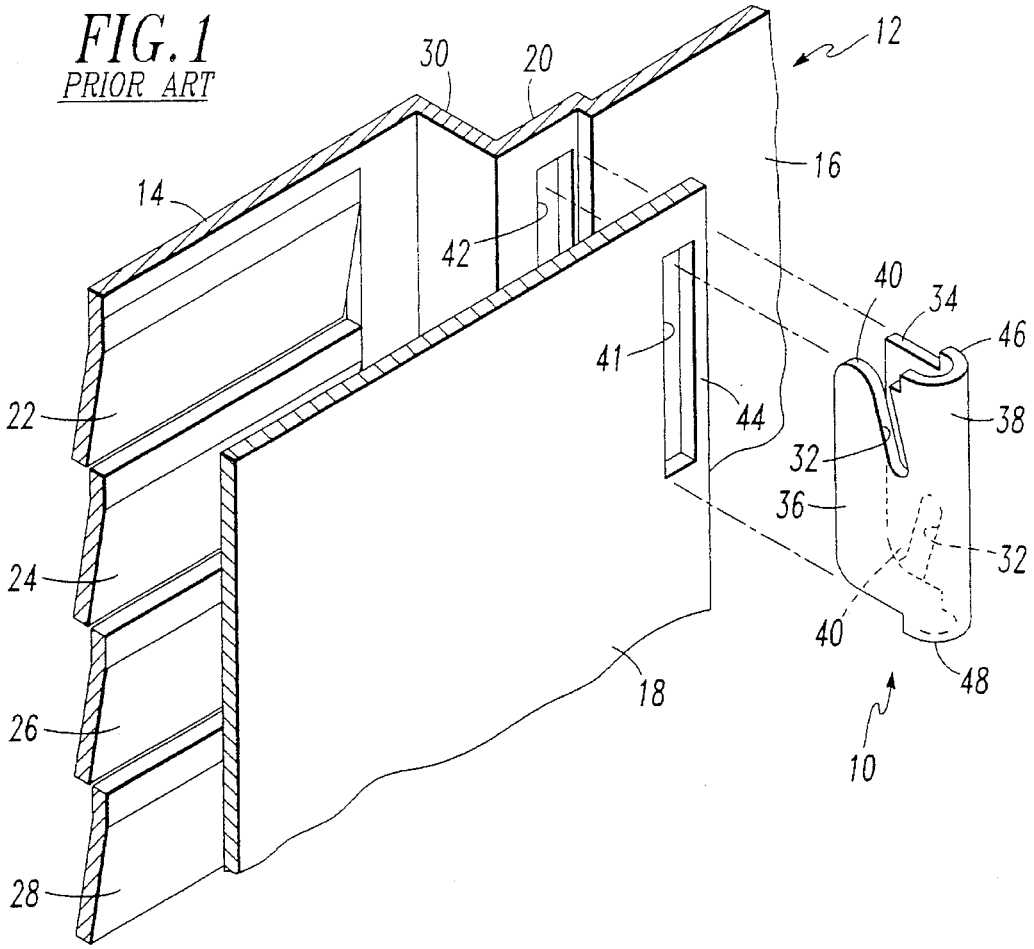
FIG. 1 PRIOR ART
FIG. 1 is an exploded partial perspective view of an enclosure for a load center illustrating a first example of a hinge element of the prior art.
Figure 2:
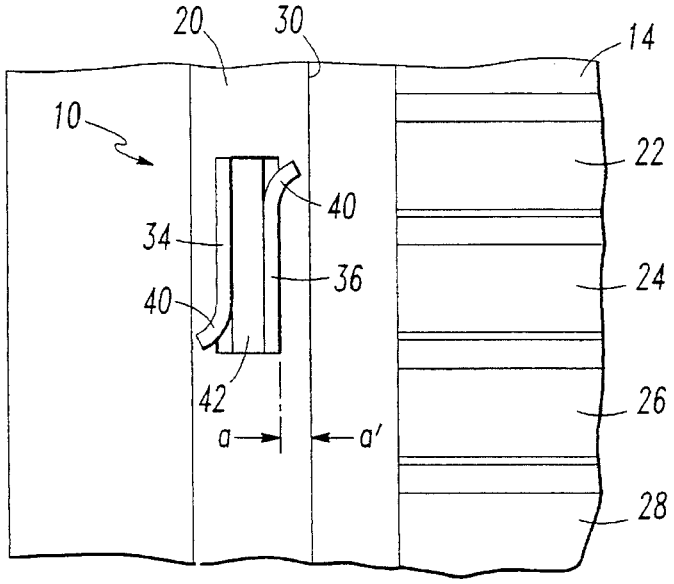
FIG. 2 PRIOR ART
FIG. 2 is a rear view showing the hinge element of FIG. 1 and the manner in which it is affixed within the enclosure of the load center.

Referring first to FIGS. 1 and 2, there is shown a first example of a hinge element 10 of the prior art discussed in the background section of this application. As shown particularly in FIG. 1, an enclosure 12 comprises an inner cover 14 integrally formed with a cover dead front 16, and a door 18 pivotally mounted by hinge element 10 to cover dead front 16. Door 18 is received in a recess portion 20 of the cover dead front 16. As discussed hereinabove, the inner cover 14 has several twist-out sections indicated at numerals 22, 24, 26, and 28 which are selectively removed to receive a circuit breaker handle (not shown) of a load center (not shown).

Recess portion 20 of cover dead front 16 terminates to form a peripheral ledge 30 which forms a central opening in cover dead front 16 and which fits into a wall opening where the circuit breaker handles are located.

Hinge element 10 is U-shaped with spaced-apart wall members 34 and 36 bridged by a curved portion 38 and has retaining means on each wall member 34, 36. Each retaining means has a bendable tab 40. Each tab 40 is located diagonally relative to each other and is formed by a slanted slot 32 formed into a lateral edge of each wall member 34, 36.

In installing hinge element 10, wall member 36 is inserted in aperture 41 of door 18 and through aperture 42 in cover dead front 16 while wall member 34 is brought around the longitudinal edge 44 of aperture 41 in door 18 and inserted into aperture 42 of cover dead front 16. Lip sections 46 and 48 of hinge element 10 adjacent to bendable tabs 40 abut the peripheral surface around aperture 41 of door 18 to assist in keeping hinge element 10 in position relative to door 18, with bendable tabs 40 extending through and out of aperture 42 in cover dead front 16 and bent in a direction outwardly relative to aperture 42 in cover dead front 16 as shown in FIG. 2. Since hinge element 10 is generally made of sheet metal, such as stainless steel, each tab 40 is bent manually with a tool, such as pliers. FIG. 2 illustrates the wide gap a-a' existing between aperture 42 in cover dead front 16 and peripheral ledge 30 of central opening in cover dead front 16 which allows tab 40 of wall member 36 to be bent by a tool in the manner shown therein and as discussed hereinabove.

Referring now to FIGS. 3 and 4, there is shown a further example of a hinge element 50 of the prior art which is also discussed in the background section of this application. As shown particularly in FIG. 3, an enclosure 52 comprises an inner cover 54 with twist-out sections indicated at 58, 60, 62, 64, a cover dead front 56 which is a separate piece from and adjustable relative to inner cover 54, and a door 66 pivotally mounted by hinge element 50. Door 66 is received in recessed portion 68 of cover dead front 56, which portion 68 terminates to form a peripheral ledge 70 which forms a central opening in cover dead front 56, and which fits into a wall opening containing the circuit breaker handles which fit into the twist-out sections 58, 60, 62, and 64. Being that inner cover 54 and cover dead front 56 are separate pieces, the end walls of inner cover 54, part of which is indicated at numeral 74, overlaps peripheral ledge 70 of cover dead front 56 as illustrated in FIG. 3 and move into the gap b–b' existing between aperture 76 in cover dead front 56 and peripheral ledge 70 as shown in FIG. 4 and as discussed hereinabove in the background section of this application.

As particularly shown in FIG. 3, hinge element 50 is U-shaped with spaced-apart wall members 78 and 80 connected by curved portion 82 and has retaining means 84 on each wall member 78, 80. Each retaining means 84 comprises a central projection 86 punched or stamped out of each wall member 78, 80 and pointed toward the curved portion 82. Hinge element 50 is generally made of brass and, therefore, provides a degree of resiliency such that central projections 86 are automatically pushed inwardly by the walls of aperture 88 in door 66 and aperture 76 in cover dead front 56 and spring outwardly once hinge element 50 is installed to provide a positive engagement of hinge element 50 therein without any manual intervention as discussed hereinabove.

The lateral edge of wall member 80 has a cut-out portion which forms a ledge 90 with curved portion 82 and, even though not shown, wall member 78 has a ledge formed by a cut-out portion on a lateral edge which is diagonally located relative to lateral 90 of wall member 80. These ledges of wall members 78, 80 catch against the top and bottom surfaces around aperture 88 in door 66 to better affix hinge element 50 in place in an apparent manner.

FIGS. 5, 6, 7, 8, and 9 particularly show hinge elements 94 which are constructed in accordance with the teachings of the present invention.

Figure 5:
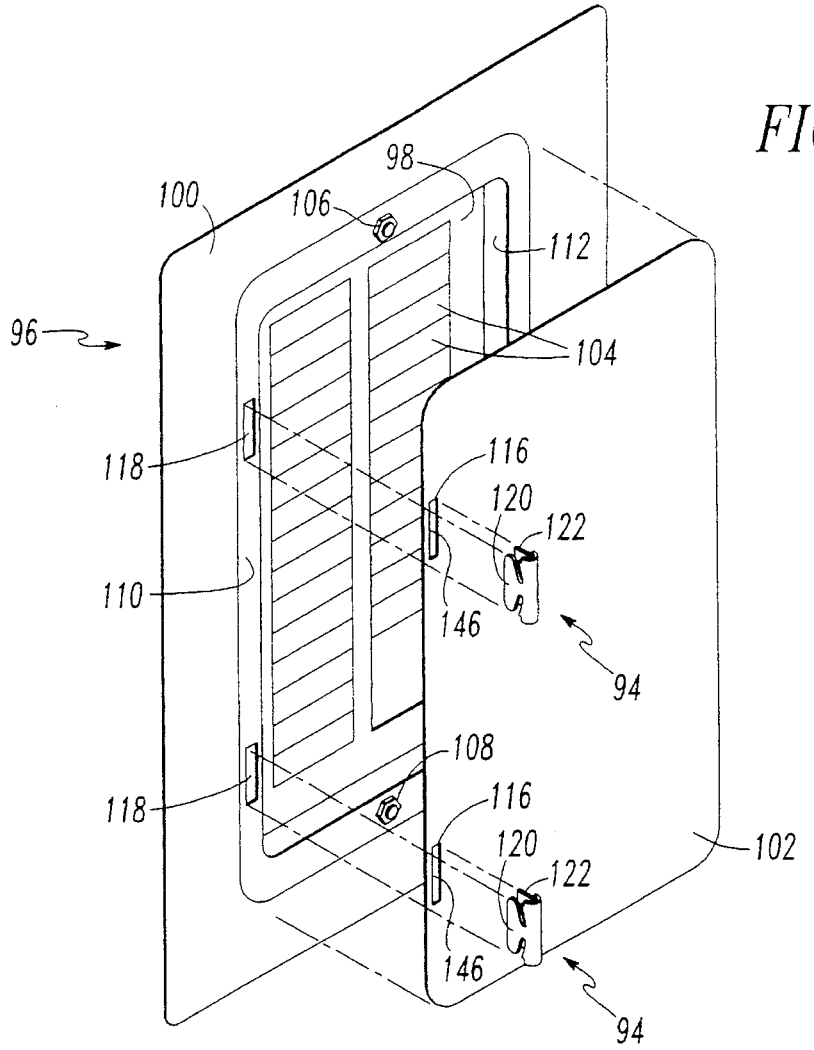
FIG. 5 is an exploded, perspective view of an enclosure of a load center incorporating the hinge elements of the present invention.

FIG. 5 gives a better representation for an enclosure 96 which typically is used for protecting and covering the circuit breaker handles in a load center. Enclosure 96 comprises inner cover 98, a cover dead front 100 which is separate from inner cover 98, and a door 102 pivotally mounted to cover dead front 100 by hinge element 94 in the usual fashion. Inner cover 98 contains several twist-out sections, one indicated at 104 for accommodating a circuit breaker handle (not shown), and is adjustable relative to cover dead front 100 through elongated screws 106, 108. Cover dead front 100 has a recess portion 110 which terminates to form peripheral ledge 112 which forms a central opening in cover dead front 100 to provide access to the circuit breaker handles extending in inner cover 98 when twist-out sections 104 are removed. Each aperture 116 in door 102 cooperates with a corresponding aperture in cover dead front 100, one of which is indicated at numeral 118 which is partially shown in recess portion 110 of cover dead front 100, to receive a hinge element 94 of the present invention for mounting door 102 to cover dead front 100 in the usual manner as explained hereinabove.

A better description of hinge element 94 of the present invention will now be given with particular reference to FIGS. 6, 7, and 8. Hinge element 94 has a U-shaped configuration with spaced-apart wall members 120, 122, curved portion 124 which connects wall members 120, 122, and retaining means 126, 128 on wall member 120, 122, respectively.

Figure 6:
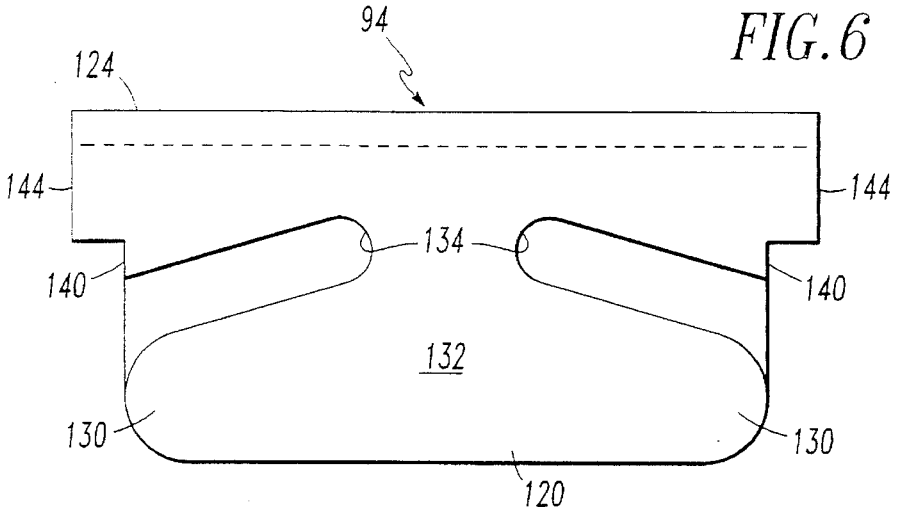
FIG. 6 is an enlarged front elevational view of one of the hinge elements of FIG. 5.

With particular reference to FIG. 6, retaining means 126 on wall member 120 comprises laterally opposed bendable tab means 130 formed by converging slots 134 made in surface 132 by a stamping or punching process. With particular reference to FIGS. 7 and 8, retaining means 128 on wall member 122 comprises a projection 136 centrally located and formed out of surface 138 by a stamping or punching process. As best seen in FIG. 8, projection 136 is slanted and points in a direction toward curved portion 124.

Figure 7:
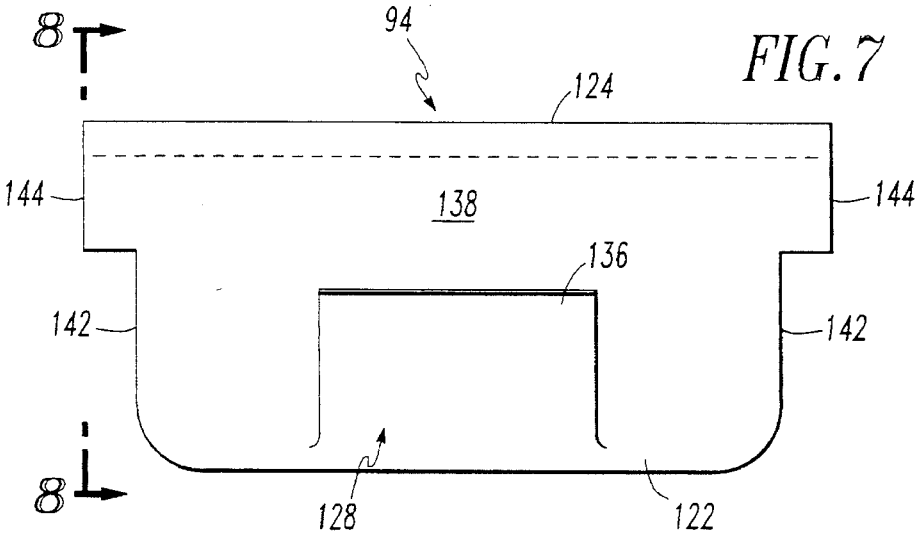
FIG. 7 is a rear elevational view of the hinge element of FIG. 6.
Figure 8:
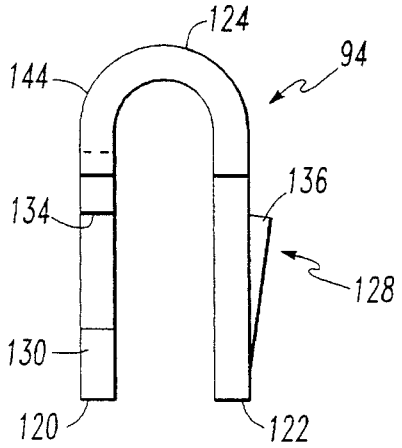
FIG. 8 is a side elevational view taken along lines 8—8 of FIG. 7.

As shown in FIGS. 6 and 7, the lateral ends 140 of wall member 120 and the lateral ends 142 of wall member 122 are formed inwardly relative to curved portion 124 to form curved edges 144 which abut against the front surface of door 102 in order to retain hinge element 94 in apertures 116 and 118 of door 102 and cover dead front 100, respectively, in the usual manner.

Hinge element 94 is installed by inserting wall member 120 into door aperture 116 and into aperture 118 of cover dead front 100 with curved portion 124 wrapping around the longitudinal edge 146 (FIG. 5) along door aperture 116 and by inserting wall member 122 into aperture 118 of cover dead front 100. Projection 136 on wall member 122 automatically snaps into place and catches a back surface of cover dead front 100 bordering aperture 118 and bendable tab means 130 on wall member 120 projects out of aperture 118.

Figure 9:
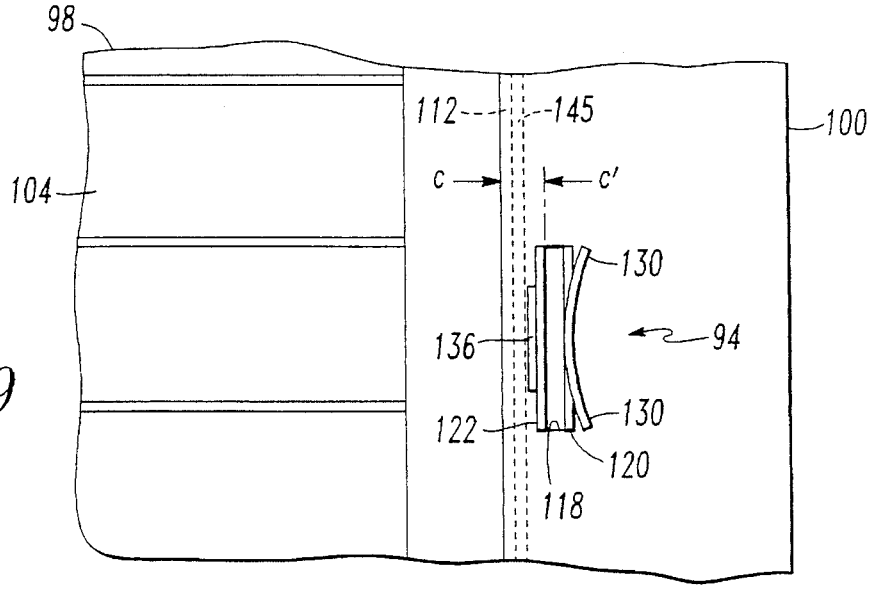
FIG. 9 is a partial, enlarged rear elevational view of the enclosure of FIG. 5 illustrating the hinge element of the present invention and the manner in which it is affixed within the enclosure of the load center.

FIG. 9 shows the manner in which projection 136 provides a positive retention for wall member 122, and the manner in which bendable tab means 130, extending through aperture 118 are then bent outwardly with a tool, such as pliers, relative to aperture 118 for a complete retention of hinge element 94 in aperture 118 for an operable mode for hinge element 94. Since inner cover 98 and cover dead front 100 are individually firmed pieces, a longitudinal end wall 145 of inner cover 98 overlaps the peripheral ledge 112 of the central opening in cover dead front 100 similar to that shown in FIG. 3 of the prior art. This overlapping causes end wall 146 of inner cover 98 to take up most of the area in the gap c–c' existing between aperture 118 in cover dead front 100 and the peripheral ledge 112 of the central opening, and the need, therefore, for the type of retaining means in the form of projection 136 on wall member 122 since no additional space exists in order to bend the retaining means in the manner in which bendable tab means 130 are bent manually with a tool.

As can also be seen in FIG. 9, the amount of the extension of projection 136 in its operable, retentive mode is preferably less than the amount of extension for bendable tab means 130 when in their operable, retentive mode.

Hinge element 94 is made of a sheet metal such as stainless steel.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. In a hinge assembly for pivotally mounting a door to a dead front cover of an enclosure for circuit breaker handles of a load center, said hinge assembly, comprising:

a hinge element formed by spaced-apart wall members, a first of said wall members having a projection formed out of the surface of said first of said wall members, and a second of said wall members having laterally opposed, bendable tab means, said projection providing a positive partial retention of said first of said wall members in said cover dead front upon insertion of said hinge element into said cover dead front, and said bendable tab means of said second of said wall members being bent after said hinge element is inserted into said cover dead front for said mounting of said door to said cover dead front.

2. In a hinge assembly of claim 1, wherein said laterally opposed, bendable tab means are an internal part of said second of said wall members and are formed by converging slots therein.

3. In a hinge assembly of claim 1 wherein said hinge element is made of stainless steel.

4. In a hinge assembly of claim 1, wherein said hinge element is U-shaped and includes a curved portion connecting said wall members.

5. In a hinge assembly of claim 1 wherein said enclosure comprises said cover dead front and said door and further comprises an inner cover with twist-out sections for receiving said circuit breaker handles, said inner cover being separate from and adjustable relative to said cover dead front, wherein said cover dead front has a central opening for providing access to said inner cover and said circuit breaker handles, wherein said first of said wall members containing said projection is located in close proximity to said central opening of said cover dead front and said second of said wall members containing said bendable tab means is located remotely from said central opening of said cover dead front when said hinge element is installed in said enclosure, and wherein the amount of extension of said projection when in an operable mode is less than the amount of extension of said bendable tab means when in an operable mode, whereby said projection requires less space than said bendable tab means for their said respective operable modes.

* * * * *